US006482244B2

(12) United States Patent
Tselesin

(10) Patent No.: US 6,482,244 B2
(45) Date of Patent: Nov. 19, 2002

(54) PROCESS FOR MAKING AN ABRASIVE SINTERED PRODUCT

(75) Inventor: Naum N. Tselesin, Atlanta, GA (US)

(73) Assignee: Ultimate Abrasive Systems, L.L.C., Atlanta, GA (US)

( * ) Notice: Subject to any disclaimer, the term of this patent is extended or adjusted under 35 U.S.C. 154(b) by 0 days.

(21) Appl. No.: 09/748,853

(22) Filed: Dec. 28, 2000

(65) Prior Publication Data

US 2001/0023558 A1 Sep. 27, 2001

Related U.S. Application Data

(63) Continuation-in-part of application No. 09/722,312, filed on Nov. 28, 2000, now abandoned, which is a continuation-in-part of application No. 09/055,217, filed on Apr. 6, 1998, now Pat. No. 6,273,082, which is a division of application No. 08/480,715, filed on Jun. 7, 1995, now Pat. No. 5,791,330, and a continuation-in-part of application No. 09/444,840, filed on Nov. 22, 1999.

(60) Provisional application No. 60/168,680, filed on Dec. 3, 1999.

(51) Int. Cl.[7] ..... B24D 18/00

(52) U.S. Cl. ..... 51/293; 51/307; 51/308; 51/309

(58) Field of Search ..... 51/307, 308, 309, 51/293; 451/546, 542

(56) References Cited

U.S. PATENT DOCUMENTS

| | | | | |
|---|---|---|---|---|
| 2,268,663 | A | 1/1942 | Kuzmick | 51/206 |
| 2,811,960 | A | 11/1957 | Fessel | 125/15 |
| 3,127,715 | A | 4/1964 | Christensen | 51/206 |
| 3,176,675 | A | 4/1965 | Bomba | 125/15 |
| 3,353,526 | A | 11/1967 | Daem | 125/15 |
| 3,537,491 | A | 11/1970 | Kolesh | 143/133 |
| 3,742,655 | A | 7/1973 | Oliver | 51/356 |
| 4,481,016 | A | 11/1984 | Campbell et al. | 51/295 |
| 4,525,179 | A | 6/1985 | Gigl | 51/209 |
| 4,554,117 | A | 11/1985 | Ezis et al. | 264/67 |
| 4,668,248 | A | 5/1987 | Dettelbach | 51/293 |
| 4,679,541 | A | 7/1987 | Fish | 125/51 |
| 4,793,828 | A | 12/1988 | Burnand | 51/293 |
| 4,925,457 | A | 5/1990 | DeKok et al. | 51/293 |
| 5,049,165 | A | 9/1991 | Tselesin | 51/295 |
| 5,092,910 | A | 3/1992 | Dekok et al. | 51/295 |
| 5,096,465 | A | 3/1992 | Chen et al. | 51/295 |
| 5,147,001 | A | 9/1992 | Chow et al. | 175/428 |
| 5,190,568 | A | 3/1993 | Tselesin | 51/293 |
| 5,203,880 | A | 4/1993 | Tselesin | 51/293 |
| 5,215,072 | A | 6/1993 | Scott | 125/21 |
| 5,238,074 | A | 8/1993 | Tibbitts et al. | 175/428 |
| 5,518,443 | A | 5/1996 | Fisher | 451/540 |
| 5,791,330 | A | 8/1998 | Tselesin | 125/15 |
| 6,039,641 | A | 3/2000 | Sung | 451/540 |
| 6,110,031 | A | 8/2000 | Preston et al. | 451/541 |
| 6,196,911 | B1 | 3/2001 | Preston et al. | 451/548 |

FOREIGN PATENT DOCUMENTS

| | | | |
|---|---|---|---|
| CH | A-0611202 | 5/1979 | |
| CN | 2032111 U | 8/1989 | |
| DE | 2540204 | 7/1977 | 125/15 |
| DE | U-8804035 | 3/1988 | |
| DE | U-9110796 | 8/1991 | |
| EP | 0 086 086 | 8/1983 | |
| EP | 0 527 344 A2 | 2/1993 | |
| EP | 0 774 242 A2 | 11/1996 | |
| FR | A-2091496 | 1/1972 | |
| GB | A-0580867 | 9/1946 | |
| GB | 580867 | 9/1946 | |
| GB | 1167606 | 10/1969 | |
| JP | 35-6296 | 6/1960 | |
| JP | 53-6296 | 6/1960 | |
| JP | 53-69994 | 6/1978 | |
| JP | 54-82788 | 7/1979 | |
| JP | 55-58983 | 5/1980 | |
| JP | 56-116166 | 3/1981 | |
| JP | 57-132973 | 8/1982 | |
| JP | 040268 | 3/1983 | 125/15 |
| JP | 59-115163 | 7/1984 | |
| JP | 59-191256 | 12/1984 | |
| JP | 60-92406 | 5/1985 | |
| JP | 61-142076 | 6/1986 | |
| JP | 62-181363 | 11/1987 | |
| JP | 62-255069 | 11/1987 | |
| JP | 62-264869 | 11/1987 | |
| JP | 63-34075 | 2/1988 | |
| JP | 63-34077 A | 2/1988 | |
| JP | 1-205975 | 8/1989 | |
| WO | 98/45091 | 10/1998 | |
| WO | 98/45092 | 10/1998 | |
| WO | WO 99/28088 | 6/1999 | |
| WO | 99/39876 | 8/1999 | |

OTHER PUBLICATIONS

"Fundamentals of Designing and Technology of Manufacturing Abrasive and Diamond Tools," Edited by Yu M. Kevalchuk, Moscow, Mashinostroenie Publishing House, 1984, pp. 172–174, w/English translation of Official Action issued by Russian Patent Office indicating relevance of reference. (No month).

GranQuartz Stone Tools and Equipment, vol. I–2000, pp. 22 and 23.

*Primary Examiner*—Michael Marcheschi
(74) *Attorney, Agent, or Firm*—Finnegan, Henderson, Farabow, Garrett & Dunner, L.L.P.

(57) ABSTRACT

A method for making an abrasive product comprising forming a structure of a sinterable retaining matrix having at least one first region containing a plurality of abrasive particles embedded therein and at least one second region containing substantially less or no abrasive particles adjacent the first region, at least one of the regions substantially surrounding the other of the regions, sintering the structure to form a unitary structure, wherein the first and second regions are integrated along a border between the regions, and extracting at least the first region from the unitary structure to form an abrasive product.

25 Claims, 4 Drawing Sheets

PROCESS FOR MAKING AN ABRASIVE SINTERED PRODUCT

RELATED APPLICATIONS

This application is a continuation-in-part of U.S. application Ser. No. 09/722,312, filed Nov. 28, 2000 (now abandoned) which claims priority of provisional application Serial No. 60/168,680 filed Dec. 3, 1999, and which is a continuation-in-part of U.S. application Ser. No. 09/055,217 filed Apr. 6, 1998, (now U.S. Pat. No. 6,273,082) which is a divisional of application Ser. No. 08/480,715 filed Jun. 7, 1995 (now U.S. Pat. No. 5,791,330), and is also a continuation-in-part of application Ser. No. 09/444,840 filed Nov. 22, 1999.

BACKGROUND OF THE INVENTION

This invention relates to a process for making an abrasive sintered product and more particularly, to a process for extracting a useful abrasive product from a sintered unitary structure having at least one first region containing a plurality of abrasive particles embedded therein and at least one second region containing substantially less or no abrasive particles adjacent the first region. The abrasive product can then be readily extracted from the structure by cutting or otherwise fracturing the structure through the second region or along the borderlines between the two regions.

U.S. Pat. Nos. 4,925,457; 5,092,910; and 5,791,330 teach cutting abrasive products out of structure of a sintered retaining matrix containing a plurality of abrasive particles. The structure can contain a mesh-type material as shown in the '457 and '910 patents or no mesh-type material as shown in the '330 patent. However, in these structures the particles are distributed throughout the structure so that if a product is to be cut out of the larger structure, it is necessary to cut through the abrasive containing material which is not only difficult and time consuming, but can lead to inaccurate results and premature cutting tool wear.

U.S. Pat. No. 5,980,678 shows sintered abrasive materials having a pattern of first regions containing a plurality of abrasive particles and a second region adjacent to and surrounding the first region and fully integrated therewith containing no abrasive particles. The purpose is to form a patterned abrasive material having abrasive particles in some parts and no particles in others, but there is no suggestion to cut up the material to provide abrasive products of just the first regions or of the first regions with some of the second regions integrated therewith.

U.S. Pat. No. 5,620,489 also shows sintered abrasive material having a fist region containing a plurality of abrasive particles and a second region along one side thereof containing no particles fully integrated therewith. A purpose for the second region is to provide a "foot" to the first region containing no abrasive particles enabling the material to be more readily attached to a cutting tool. The reference discloses that such material can be cut up into pieces of the required shape and mounted on a suitable carrier. However, to provide such pieces it would be necessary to cut through not only the second region, but also the first region containing the abrasive particles.

SUMMARY OF THE INVENTION

In accordance with the invention, a new and improved method is provided for making an abrasive product comprising forming a structure of a sinterable retaining matrix having at least one first region containing a plurality of abrasive particles embedded therein and at least one second region containing substantially less or no abrasive particles adjacent said first region, at least one of said regions substantially surrounding the other of said regions, sintering said structure to form a unitary structure wherein said first and second regions are integrated along a border between said regions, and extracting at least said first region from said unitary structure to form an abrasive product.

BRIEF DESCRIPTION OF THE DRAWINGS

The detailed features and advantages of the invention will now be explained in connection with the accompanying drawings in which.

DETAILED DESCRIPTION OF THE INVENTION

Figure 1:
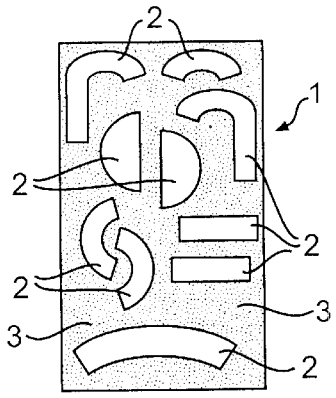
FIG. 1 is a plan view of a unitary structure of flat configuration illustrating shapes of cutting segments to be cut from the structure.

The structure from which the abrasive products are extracted may, for example, be of flat or undulating configuration such as a corrugated sheet of material and may be an essentially one or two dimensional plate or 3-dimensional block.

The types of abrasive particles in the two regions can be different in composition, size, and shape. In a preferred embodiment the second region comprises little or no abrasive particles to aid in the extraction of the products from the structure and the abrasive particles are diamonds.

The abrasive particles may be randomly or non-randomly distributed in one or the other or both of the regions or in selected areas of the regions. In a particularly preferred embodiment, at least the first regions contain predominately non-randomly distributed abrasive particles. For providing a distribution, e.g., a non-random one, of the abrasive particles in the first regions of the structure, reference by way of example is made to one or more of the following U.S. Pat. Nos. 4,925,457; 5,049,165; 5,092,910; 5,190,568; 5,203,880; 5,380,390; 5,620,489; 5,791,330; 5,817,204; and 5,980,678, all of which are incorporated therein by reference.

Any hard particles capable of performing an abrasive function can be used in this invention. For a list of suitable abrasive particles, see for instance U.S. Pat. No. 5,791,330. For example, these hard particles include carbons, e.g., diamonds (i.e., natural synthetic and polycrystalline diamonds); nitrides (i.e., cubic boron nitride); carbides, and borides. Moreover, at least some of the hard particles can be in the form of agglomerates of the individual hard particles.

The hard particles can also be in at least one coating layer. The coating can be made by at least one of the electrodeposition methods or chemical or physical vapor deposition methods and can comprise carbide forming elements, e.g., boron and silicon and/or elements of IVA, VA, VIA groups of The Periodic Table of The Elements, e.g., chromium, titanium, molybdenum, tungsten.

The sinterable retaining matrix of the structure comprises at least one element of Group IV A, VA, VI A, VII A, VIII A, IB, IIB, IIIB, IVB, and VB of the Periodic Table. Matrix materials in the first and second regions can differ from each other at least by the elements included and/or their concentrations and/or the porosity of the sintered material. For example, preferably the content of copper, if present, in the first region could exceed the content of copper in the second region. This is especially helpful in extracting abrasive products from the structure by cutting through the second regions where there is a lower concentration of the abrasive particles than the first region with a laser.

In a particularly preferred embodiment, the structure having first regions containing abrasive particles has been sintered, preferably under pressure and/or load and can include the step of infiltration before and/or during and/or after sintering. In addition, the sinterable matrix material can consist of or in addition include fusible and/or brazable materials that when molten can infiltrate into non-molten sinterable material. Thus "sinterable matrix material" is intended to include, but is not limited to fusible and brazable materials as discussed, for example, in the above-mentioned U.S. Pat. No. 5,380,390. It is to be noted that sintering includes, but is not limited to, sintering at atmospheric or room pressure, at negative (vacuum) pressure or at positive pressure, including also placing the material under pressure and/or load. Sintering can occur in the presence of a protective and/or reduction, and/or oxidizing, and/or neutral atmosphere, in a solid and/or liquid phase and/or in the partial presence of the liquid phase; and in a mold or tray, in a furnace or in a sinter press. Examples of suitable sinterable matrix materials and more detailed methods for sintering can be found in the above-recited U.S. patents.

In one embodiment, the first regions of the structure are surrounded by and separated from each other by the second regions and the step of extracting abrasive products from the structure preferably comprises cutting the structure through the second regions either along the borders between the regions or through the second regions at a distance spaced from the borders.

In a preferred embodiment, a part of the second regions form a part of the first regions extracted from the structure. For example, if the first regions contain abrasive particles and the second regions essentially no abrasive particles, the extracted products can have a portion on at least one side thereof, derived from the second region that contains no abrasive material, to provide a "foot" and/or a peripheral area for the products that enables them to be readily fixed to the working edge or a carrier or a surface of an abrasive machining tool.

One method for providing a structure having areas containing abrasive particles and areas containing essentially no abrasive particles, comprises blocking designated regions when making the structure by the use of a mask as disclosed in U.S. Pat. Nos. 5,380,390; 5,817,204; and 5,980,678. Alternatively, the structure may be prepared by filling materials with a lower concentration of or no abrasive particles into one section of an assembly or a compacting or sinter mold or a sinter tray and materials having higher concentrations of particles in other sections and then sintering the materials to form a unitary structure containing both first and second regions.

Another method comprises providing a plurality of blocks of sinterable matrix material containing differing amounts of abrasive material, assembling the blocks in abutting relationship to form an assembly and then sintering the assembly, preferably under pressure and/or load, to form a unitary structure containing regions that contain particles (i.e., first regions) and regions that do not (i.e., second regions) as taught in copending application Ser. No. 09/444,840 filed Nov. 22, 1999 entitled Method for Making a Sintered Article and Products Produced Thereby, the contents of which is incorporated herein by reference.

The bodies may be extracted from the structure by means of, for example, electrical erosion, laser, electron beam, gas-arc, water-jet breakage with or without a utilization of the mechanical breakage or fracturing before, during, or after application of said means or any combination thereof. The extracting may be along the border or junction lines between the regions or at least partially through or predominately through the second regions. Preferably, the extracting method is by cutting with a laser or water-jet that goes exclusively through the second regions of the structure. Alternatively, abrasive products can be "scooped" out of the structure. Preferably, as noted above, the extracted product comprises the first region of the structure and a portion of the second region.

More specific methods for extracting bodies can be found in the above-mentioned U.S. Pat. Nos. 5,620,489; 5,791,330; and 5,980,678 as well as the copending application Ser. No. 09/444,840 of the inventor filed Nov. 22, 1999.

The products extracted from the structure may be further processed into any desired shape or look. These include compacting, heating, cooling, sintering, coning, forging, extruding, brazing, infiltrating, impregnating, cleaning, painting, coating, plating, adhering, etching, and machining which may include deburring, laser, electron beam, flame jet, water-jet cutting, milling and grinding or any combination thereof.

The extracted products containing abrasive particles can then function as abrasive members, elements, inserts, caps, linings, straps or segments (i.e., cutting and/or grinding segments) and be fixed (either one or more) to the working surface or carrier of a machining tool. In a particularly preferred embodiment of the invention, the bodies comprise a portion of the second or service region of the structure from which the product is extracted which portion can be readily fixed to the tool carrier. Methods for fixing include soldering, brazing, sintering, welding, mechanical fixing, gluing or any combination thereof. Brazing and welding include but are not limited to electron beam processing such as laser welding or laser assisted brazing. Also discharge welding methods or machinery, e.g., of a type recently developed by Robosintris Sri of Piacenza, Italy, can be used.

In a preferred embodiment, the products connected to the tool carrier by a portion from the second region of the structure are subjected to a further dressing process which may include abrasive, water-jet, or laser treatment or any combination thereof.

In a particularly preferred embodiment, at least one of a plurality of extracted products containing abrasive particles are fixed to the carrier or core of a machining tool through foot portions containing no abrasive particles. Such tools may include tools providing abrasive cutting, drilling, grinding, dressing and polishing functions such as circular segment blades, reciprocating segment blades, wire beads and blades, dressers, drill bits, face grinding tools, and the like.

Preferred embodiments of the invention will now be illustrated with reference to the drawings.

FIG. 1 is an example of a structure 1 in the form of a flat plate having first regions 2 of various shapes containing abrasive particles and second regions 3 substantially surrounding the first regions containing no abrasive particles. This plate can be made, for example, by the process disclosed in U.S. Pat. No. 5,817,204, the contents of which are incorporated herein by reference, by providing a preform of sinterable matrix material, such as a soft, easily deformable and flexible preform of U.S. Pat. No. 5,620,489, the contents of which are also incorporated herein by reference, coating one surface of the preform with an adhesive and then placing a mask over the adhesive coated side of the preform having openings corresponding to the various shapes of the desired cutting segments. Abrasive particles are then applied over the top of the mask, the particles adhering to the adhesive coating in the openings of the mask.

The abrasive particles can be randomly distributed in the openings or if desired can be distributed in a non-random pattern by means of, for example, a mesh material on top of the preform or on top of the mask. Following application of the abrasive particles the hard particles not adhering to the adhesive coating and the mask are removed. If a mesh material is used between the preform and the mask, it can also be removed or, alternatively, it can be left to form a part of the sintered plate and the cutting segments cut therefrom.

Pressure is then applied to the preform to urge the abrasive particles into the preform and preform is then heated under pressure to sinter the preform and form the structure 1 having first regions 2 of various shapes corresponding to the openings in the mask containing abrasive particles and second regions 3 substantially surrounding the first regions containing no abrasive particles. The particles and mesh if present can be urged into the preform before the preform is sintered under pressure or simultaneously with the sintering of the preform.

While use of an adhesive for the purpose of temporarily retaining the abrasive particles in a non-random pattern prior to and in the process of sintering is preferred, as taught in U.S. Pat. Nos. 4,925,457; 5,049,165; 5,092,910; 5,190,568; and 5,203,880, it is still possible to obtain a non-random pattern without the use of an adhesive. Thus the present invention is not limited to use of adhesives in the process of making the sintered plate.

Figure 5:
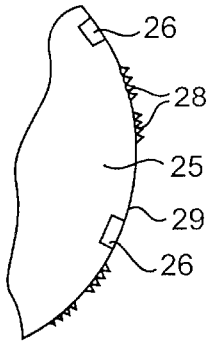
FIG. 5 is a fragmentary side elevational view showing a cutting tool having the cutting segments of FIGS. 2-4 mounted thereon.
Figure 6:
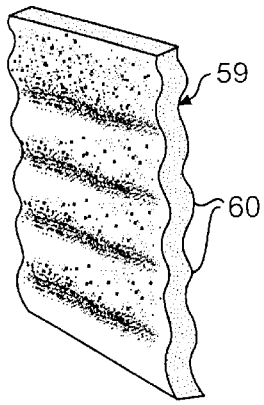
FIG. 6 is a structure similar to FIG. 1, but of contoured configuration.
Figure 2A:
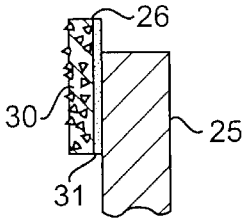
FIGS. 2A, 2B, and 2C show various cutting segments extracted from the structure of FIG. 1 and mounted on the working edge of a cutting tool.
Figure 2B:
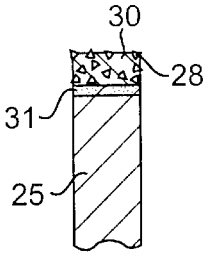
Figure 2C:
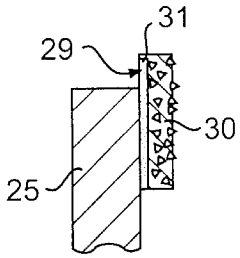
Figure 3A:
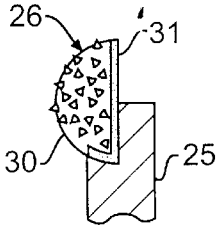
FIGS. 3A, 3B, and 3C show similar cutting segments of an alternative shape.
Figure 3B:
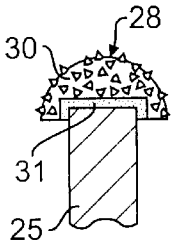
Figure 3C:
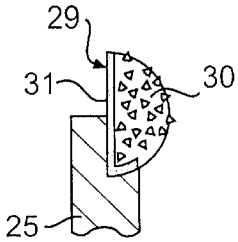
Figure 4A:
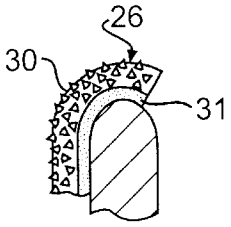
FIGS. 4A, 4B, and 4C show similar cutting segments of yet another alternative shape.
Figure 4B:
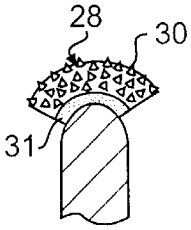
Figure 4C:
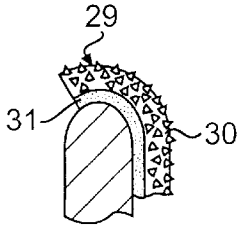

This enables various shaped cutting segments 26, 28, and 29 to be easily extracted from the plate, each having an abrasive particle containing portion 30 and a "foot" portion 31 devoid of particles as shown in FIGS. 2–4. As discussed above, these segments can be extracted from the plate by cutting in the second region along the borderline between the regions along the sides of the segments that will form their cutting surface and at a distance spaced from the side or sides that will be secured to a cutting tool to provide the foot portion 31. These segments can then be fixed in a regular and spaced manner to the core 25 of a machining tool as shown in FIG. 5 by securing the foot of the segments to the core. These cutting segments are described in greater detail in U.S. Pat. No. 5,791,330, the contents of which are incorporated herein by reference.

Alternatively, the cutting segments can be cut from a sheet of abrasive material 59 having corrugations 60 with regions containing abrasive particles and regions containing no particles as in FIG. 1.

Figure 7A:
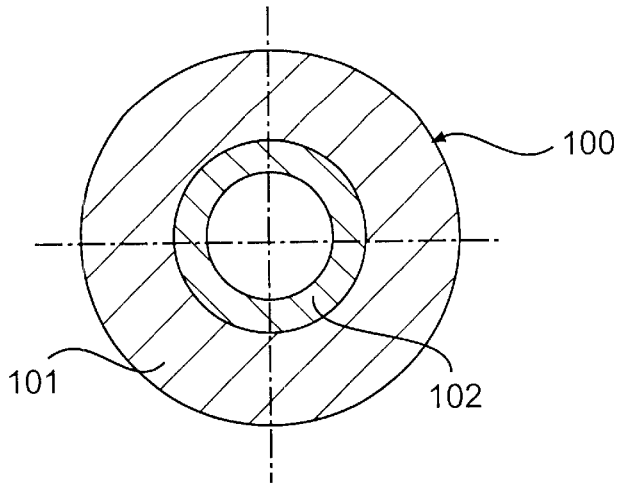
FIG. 7A shows a cutting element of annular configuration.
Figure 7B:
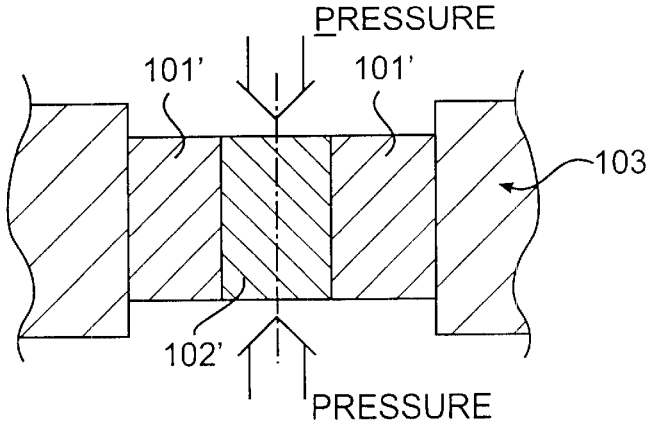
FIG. 7B illustrates a method for making a structure from which the cutting element of FIG. 7A can be formed.
Figure 7C:
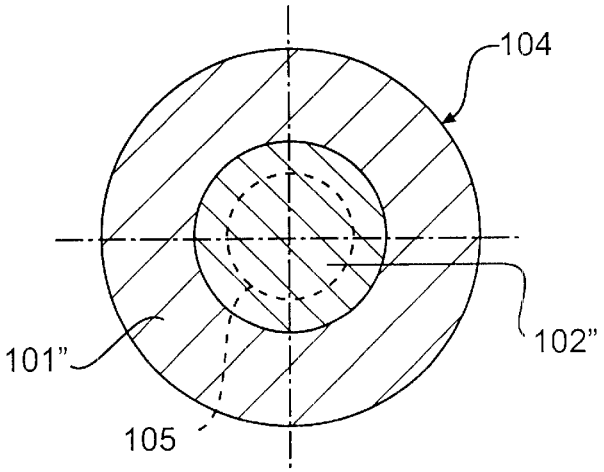
FIG. 7C illustrates the structure formed in FIG. 7B.

FIG. 7A illustrates an alternative embodiment of the invention showing a cutting segment 100 having an abrasive particle containing region 101 and a non-abrasive particle containing region or foot 102. The segment can be prepared by providing a structure of a first sinterable material 101' containing abrasive particles and of annular shape and a core of a second sinterable material 102' containing no particles that is substantially surrounded by the first material. The structure is then sintered providing a diffusion between material 101' and 102', for example in sinter press 103 under pressure as shown in FIG. 7B to form a unitary structure 104 as shown in FIG. C having a particle containing region 101" fully integrated along its inner border with no particle containing region 102". Structure 104 is then cut along the line 105 to provide the cutting segment 100 of FIG. 7A.

Figure 8:
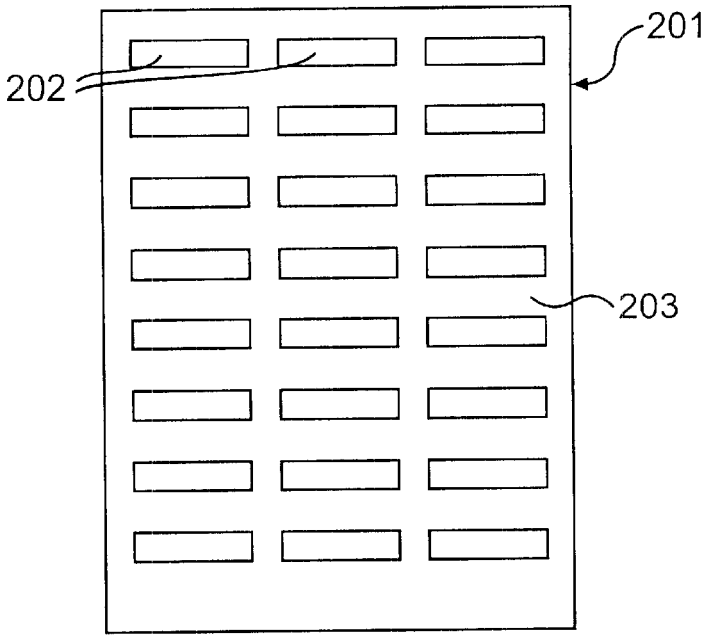
FIG. 8 is a structure similar to FIG. 1 showing a plurality of cutting segments of the same shape and size.
Figure 9:
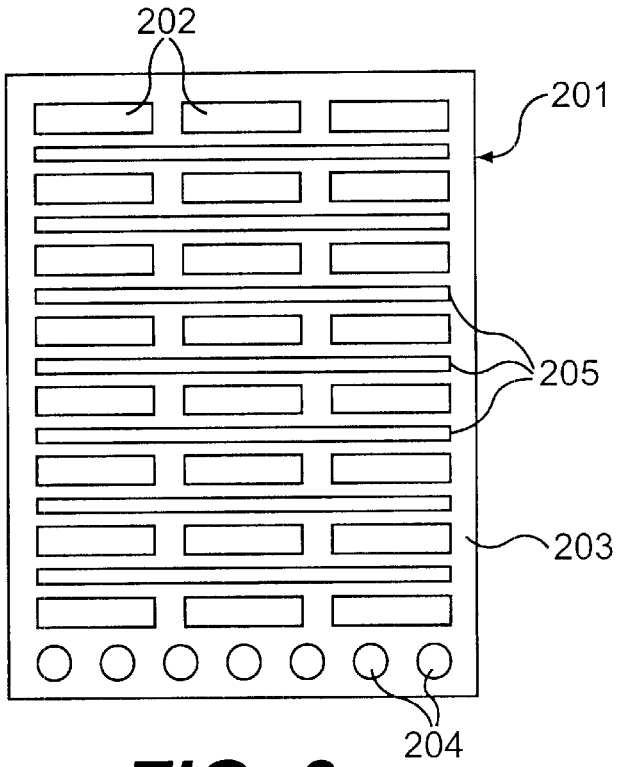
FIG. 9 is a view similar to FIG. 8 showing a plurality of cutting segments of different shapes and sizes.

As shown in FIG. 1, the regions 2 of a variety of shapes and dimensions can be arbitrarily distributed within the structure 1. However, the structure 1 may comprise one or a plurality of substantially the same or different regions 2. For example, FIG. 8 illustrates a structure 201 having first regions 202 each containing abrasive particles of substantially the same rectangular shape and dimension distributed within the structure in a non-random manner and a second region 203 substantially surrounding the first regions containing no abrasive particles. It should be understood, however, as shown in FIG. 9 that more than one plurality of regions 202 (different by shapes and dimensions such as regions 204 and 205) could be distributed within the structure 201, for example, for the sake of increasing utilization of the structure by maximizing the number of regions to be extracted from it. Further, the sequence of the extraction, e.g., cutting, can be arbitrary or be pre-programmed, optimized according to the desired algorithm.

Abrasive parts, e.g., segments in the form of regions 202 (with or without a portion of region 203 attached) can be extracted from the structure one by one or in groups. Further, the parts, e.g., can be extracted completely, i.e., fully separated from the structure or only partially therefrom. A partial extraction provides some integrity between a non-completely extracted abrasive part and the structure. It means that while extracting an abrasive part partially, at least one little bridge or tab, preferably in a region 202, is left to connect the partially extracted abrasive part to the structure 201. Such partial extraction allows greater ease in transporting and moving the structure 201 with non-completely extracted abrasive parts within and outside the extraction machine (i.e., laser, water jet) and other equipment without having to deal with a plurality of loose, individual extracted abrasive parts. Partially extracted abrasive parts can then be completely extracted from the structure simply by breaking the bridge or tab. For example, the bridge or tab could be broken by a mechanical fracturing or breaking, e.g., hammering, compression air blow-up, vibration, etc.

Figure 10:
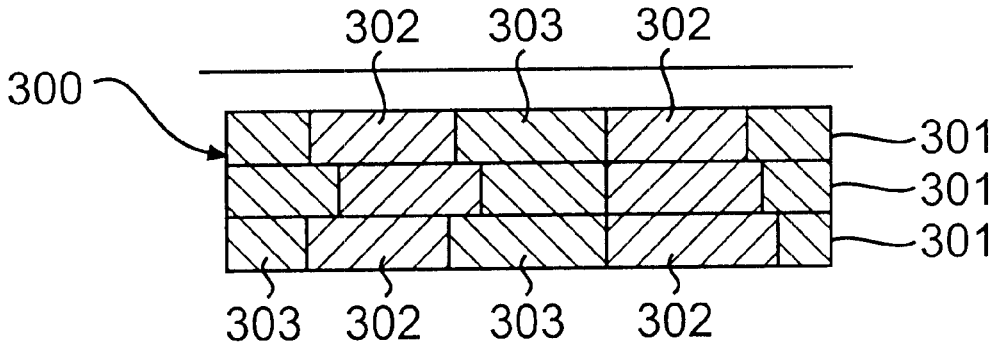
FIG. 10 is a sectional view of a structure made from a plurality of structures similar to FIG. 8.

With reference to FIG. 10, two or more structures or plates 301 similar to the structure 201 of FIG. 8 can be assembled or stacked together and integrated by brazing, fusing or sintering to form a unitary structure 300. The plates 301 are stacked together in such a way that second regions 303 of the plates containing substantially less or no abrasive particles at least partially overlap or coincide with each other in at least one plane as shown. The assembly can then be cut through the regions 303 to extract abrasive parts comprising a plurality of staked regions 302 containing abrasive particles. In this way abrasive parts of greater thickness and/or of varied cross-sectional shape and/or of layers of different compositions can be readily and efficiently produced.

Other embodiments of the invention will be apparent to those skilled in the art from consideration of the specification and practice of the invention disclosed herein. It is intended that the specification and specific embodiments be considered as exemplary only, with the true scope and spirit of the invention being indicated by the following claims.

I claim:

1. A method for making an abrasive product comprising forming a structure of a sinterable retaining matrix having at least one first region containing a plurality of abrasive particles embedded therein and at least one second region containing substantially less or no abrasive particles adjacent said first region, at least one of said regions substantially surrounding the other of said regions, sintering said structure to form a unitary structure, wherein said first and second regions are integrated along a border between said regions, and at least partially extracting at least said first region from said unitary structure to form an abrasive product.

2. The method of claim 1, wherein the abrasive product is extracted from the unitary structure by cutting through said second region along the border immediately adjacent said first region to provide an abrasive product comprising essentially said first region.

3. The method of claim 1, wherein the abrasive product is extracted from the unitary structure by cutting through said second region at a distance from said border to provide an abrasive product comprising said first region and a portion of the second region.

4. The method of claim 1, wherein the second region substantially surrounds said first region.

5. The method of claim 4, wherein the product is extracted from the unitary structure by cutting through said second region partially along the border immediately adjacent said first region and partially at a distance from said border to provide an abrasive product comprising said first region and a portion of said second region.

6. The method of claim 4, wherein the structure is in the form of a flat plate.

7. The method of claim 4, wherein the structure is in the form of a corrugated sheet.

8. The method of claim 1, wherein the first region substantially surrounds the second region.

9. The method of claim 8, wherein the product is extracted from the structure by cutting through said second region at a distance from said border to provide an abrasive product comprising said first region and a portion of said second region.

10. The method of claim 9, wherein said first region is annular and the portion of said second region forms an annular core inside of said first region.

11. The method of claim 1, wherein the plurality of abrasive particles are embedded in the first region in a non-random pattern.

12. The method of claim 1, wherein the plurality of particles are distributed in the first region in a random pattern.

13. The method of claim 1, wherein the second region contains no abrasive particles.

14. The method of claim 1, containing a plurality of said first regions, each surrounded by said second region.

15. The method of claim 1, wherein the plurality of abrasive particles are embedded in the first region before sintering.

16. The method of claim 1, wherein the plurality of abrasive particles are embedded in the first region during sintering.

17. The method of claim 11, wherein the plurality of abrasive particles are embedded in a non-random pattern in the first region by means of a mesh material.

18. The method of claim 17, wherein the mesh material is incorporated in said first region and forms a part of said abrasive product.

19. The method of any one of claims 2, 3, or 5, wherein the second region is cut with a laser or water-jet.

20. The method of claim 14, wherein the plurality of said first regions are of the same size and shape.

21. The method of claim 14, wherein the plurality of said first regions are of at least two different sizes and shapes.

22. The method of claim 14, wherein the plurality of said first regions are extracted from the unitary structure individually.

23. The method of claim 14, wherein the plurality of said first regions are extracted from the unitary structure simultaneously.

24. The method of claim 14, wherein the plurality of said first regions are extracted completely from the structure.

25. The method of claim 14, wherein the plurality of said first regions are only partially extracted from the structure to leave a small, frangible bridge connecting the first regions to the second region.

* * * * *